United States Patent [19]

Penny et al.

[11] 4,029,433

[45] June 14, 1977

[54] STATOR VANE ASSEMBLY

[75] Inventors: Robert Noel Penny, Solihull; Peter Boden Candy, Bearley, near Stratford-upon-Avon, both of England

[73] Assignee: Caterpillar Tractor Co., Peoria, Ill.

[22] Filed: Dec. 15, 1975

[21] Appl. No.: 640,688

[30] Foreign Application Priority Data

Dec. 17, 1974 United Kingdom ..... 54347/74

[52] U.S. Cl. ..... 415/147; 415/156

[51] Int. Cl.[2] ..... F01D 17/10

[58] Field of Search ..... 415/156, 147, 157

[56] References Cited

UNITED STATES PATENTS

| | | | |
|---|---|---|---|
| 2,337,861 | 12/1943 | Adamtchik | 415/156 |
| 2,614,747 | 10/1952 | Christensen | 415/156 |
| 2,754,049 | 7/1956 | Lovesey | 415/156 |
| 3,237,918 | 3/1966 | LeBell et al. | 415/156 |
| 3,397,836 | 8/1968 | Badger et al. | 415/156 |
| 3,483,824 | 12/1969 | Sprague | 415/147 |
| 3,723,021 | 3/1973 | Bartholomew | 415/147 |

FOREIGN PATENTS OR APPLICATIONS

| | | | |
|---|---|---|---|
| 704,440 | 12/1954 | United Kingdom | 415/156 |

*Primary Examiner*—Henry F. Raduazo
*Attorney, Agent, or Firm*—Gifford, Chandler, Sheridan & Sprinkle

[57] ABSTRACT

A stator vane assembly for a compressor or turbine of a gas turbine engine. The stator vane assembly comprises a plurality of circumferentially-spaced stator vanes extending in a generally radial direction between radially spaced co-axial annular walls mounted co-axially on a rotor of the compressor or turbine. The vanes are flexible and are engaged at at least one position in the radial length thereof by an axially movable annular vane-deflecting member, whereby the vanes are deflectable in cross-sectional shape depending upon the axial position of the vane-deflecting member.

8 Claims, 8 Drawing Figures

STATOR VANE ASSEMBLY

BACKGROUND OF THE INVENTION

The invention relates to a stator vane assembly of a compressor or turbine and it is particularly, but not exclusively, concerned with adjustable inlet guide vanes for a centrifugal compressor.

An object of the invention is to provide means whereby the inlet guide vanes or other stator vanes are adjustable according to desired operating conditions of an operating parameter of a compressor or turbine fitted with the stator vane assembly or of an engine including such a compressor or turbine.

SUMMARY OF THE INVENTION

According to the invention, a stator vane assembly in or to be used in a compressor or turbine comprises a plurality of circumferentially-spaced stator vanes extending in a generally radial direction between radially spaced co-axial annular walls arranged to be mounted co-axially of a rotor of the compressor or turbine, the vanes being flexible and engaged or arranged to be engaged at at least one position in the radial length thereof by an axially movable annular vane-deflecting member, whereby the vanes are deflectable in cross-sectional shape depending upon the axial position of the vane-deflecting member.

In one form of stator vane assembly in accordance with the invention, each vane extends through an aperture in an annular wall, the vane being deflectable in the aperture between two limiting cross-sectional shapes determined by the shape of two respective boundary edges of the aperture, the annular vane-deflectable member being axially movable between two extreme positions in one of which each vane will engage one boundary edge and in the other of which the vane will engage the other boundary edge of the respective aperture. Conveniently, there is one said sleeve adjacent each radial end of the vanes and a pair of annular vane-deflecting members, one adjacent each said sleeve. The annular vane-deflecting members may be adjustable in unison or individually. By adjusting the annular vane-deflecting members individually the vanes may be deflcted to a twisted shape.

In an alternative form of stator vane assembly in accordance with the invention, the annular vane-deflecting member may have a plurality of circumferentially-spaced notches in an edge thereof adjacent the adjacent axial end edges of the vanes, the notches each being bounded by a cam surface engageable with a adjacent edge portion of the respective vane whereby the vane is deflected by the cam surface as the annular vane-deflecting member is moved axially of the assembly.

In either version of stator vane assembly, the annular vane-deflecting member or members may be adjustable axially of the assembly by manual adjustment of automatically in response to change in an operating parameter of the compressor or turbine or of an engine including the compressor or turbine.

The invention also includes a compressor or turbine comprising a bladed rotor and a stator vane assembly associated with the rotor, the stator vane assmembly being in accordance with any one of the immediately preceding four paragraphs.

BRIEF DESCRIPTION OF THE DRAWINGS

By way of example, two embodiments of adjustable inlet guide vane assemblies in accordance with the invention will now be described with reference to the accompanying drawings, in which.

DESCRIPTION OF THE PREFERRED EMBODIMENTS

Figure 1:
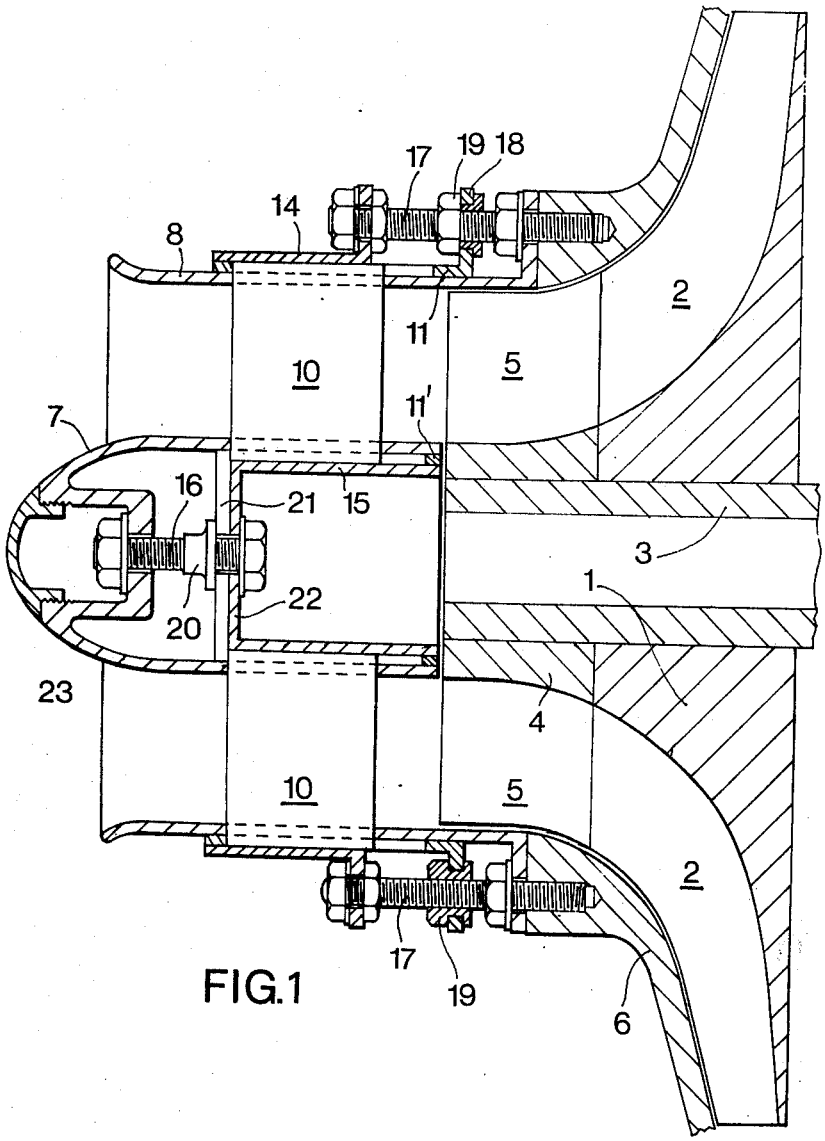
FIG. 1 is an axial sectional view through a centrifugal compressor fitted with the first embodiment of inlet guide vane assembly.
Figure 3:
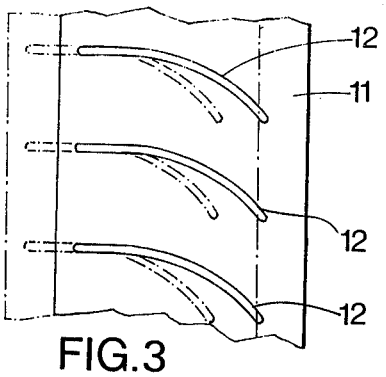
FIG. 3 is a development of a portion of a sleeve shown in FIG. 1 and slidable in directions parallel with the axis of rotation of the compressor rotor.
Figure 4:
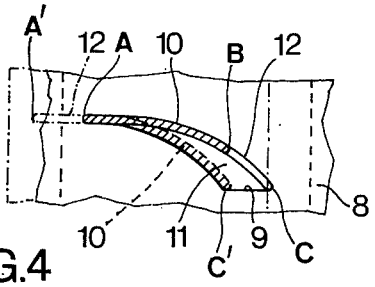
FIG. 4 is a section on the line IV—IV in FIG. 1 through an inlet guide vane and showing the sleeves shown in FIGS. 2 and 3 superimposed one on the other.

Referring firstly to FIG. 1, the centrifugal compressor comprises a rotor 1 having integral blades 2 and mounted on a shaft 3 to which there is also attached a hub 4 carrying rotatable vanes 5 fixed in relation to the compressor blades 2. The compressor rotor and the rotating vane impeller are housed within a housing 6. The adjustable inlet guide vane assembly comprises a stationary hub-like member 7 defining an inner annular wall and mounted co-axially of the rotor shaft 3 and a co-axial outer annular wall 8 forming an extension of the compressor housing 6. The annular wall of the hub-like member 7 and the annular wall 8 contain a plurality of circumferentially-spaced apertures 9 (see FIGS. 2 and 4 which show the wall 8) through which the vanes 10 extend at each end thereof. The projecting ends of the vanes 10 also pass through arcuate slots 12′, 12 in axially movable sleeves 11′, 11 respectively, the latter being the aforesaid blade-deflecting members and, slidable on the inside of the annular portion of the hub-like member 7 and on the outside of the annular wall 8 respectively. FIGS. 3 and 4 show the sleeves 11 and the slots 12 therein. The radially inner and outer ends of the vanes 10 abut against a radially-outer fixed annular wall 14 outside the sleeve 11 and a radially-inner fixed annular wall 15 inside the sleeve 11′ respectively. The axially-movable sleeve 11 is guided for sliding in the axial direction between the walls 14 and 8 and is carried by a flange or annular bracket 18 through which several circumferentially-spaced screws or bolts 17 extend. The screws 17 are located at one end in the housing 6 and support at their other ends the wall 14. A nut 19 on each screw 17 determines the axial positions of the sleeve 11 and is adjustable along the screw 17. The sleeve 11 may be guided additionally by a screw (not shown) in the wall 14 and engaging in a slot in the sleeve 11. The sleeve 11′ is slidable in the axial direction between the annular wall of the hub-like member 7 and the annular wall 15 and is similarly adjustable by tightening a nut 23 on a screw 16 which passes freely through the hub-like member 7. The screw 16 extends through and is supported by an end wall 21 integral with the sleeve 11′ and an end wall 22 integral with the annular wall 15 and is secured to the end wall 21 by a screwed collar 20. As the nut 23 is tightened the screw together with the sleeve 11′ is drawn to the left, as viewed in FIG. 1.

When the sleeves 11 and 11′ are in the positions illustrated in full lines in FIGS. 1, 3 and 4, that is they are set fully to the right, the slots 12, 12′ in those two sleeves will be in the positions such as those shown in full lines in FIGS. 3 and 4. The vanes 10 are flexible and will occupy the position indicated by the letters AB in FIG. 4 in which they are abutted against the one boundary edge of the respective aperture 9, the right-hand end of the slot 12 in the sleeve 11 being at position C and the left-hand end being at A. By adjusting the sleeves 11 and 11′ to the left, as viewed in FIGS. 1, 3 and 4, the slots 12, 12′ will take up the positions such as that shown in FIG. 4 for slot 12 between the letters A′C′. During this movement, the right-hand end of the slot 12 in moving from positon C to position C′ will deflect the respective vane 10 from the position indicated by letters AB to the position indicated by 10′ and letters AC′ in which the vane abuts the other boundary edge of the respective aperture 9. Thus it will change in cross-sectional shape, for example, from the position AB to the position AC′. The adjustment of the sleeves 11 and 11′ is performed manually and would usually be a pre-setting operation made before the operation of the engine incorporating the compressor. The adjustment in the shape of the vanes can be made in accordance with any operating condition or parameter of the compressor or the engine in which it is incorporated.

The positions of the sleeves 11 and 11′ do not have to be changed in unison. Instead they may be adjusted by different axial amounts. For example, only one of the sleeves 11 and 11′ may be re-adjusted. For example, the sleeve 11′ could be left in the position illustrated and the sleeve 11 be moved to the fully left-hand position. In that case the radially inner ends of the vanes wound remain in the position and of the shape AB while the radially outer ends would be deflected into the position and of the shape AC′ shown in FIG. 4. In this way the shape of each vane 10 at different positions along its radial length would be different and thus the vane would be twisted. Alternatively the opposite twist may be imparted to each vane by keeping the sleeve 11 in the right-hand position as illustrated and moving the sleeve 11′ to the left.

Figure 5:
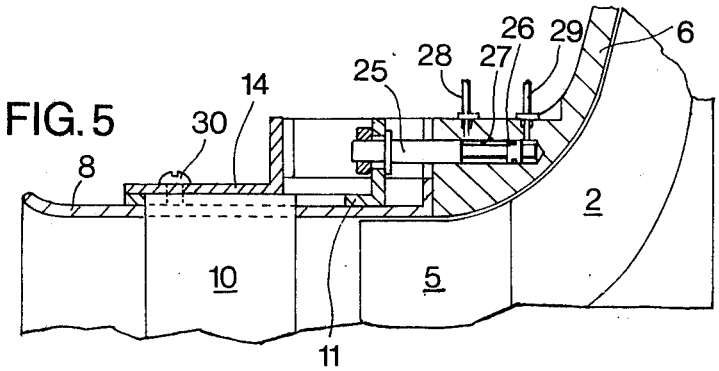
FIG. 5 is an axial sectional view similar to a portion of FIG. 1 but showing a modification including an actuator for moving the slidable sleeve shown in FIGS. 1, 3 and 4.

Although the adjustment by means of the screw 16 and the nuts 18 on the screws 17 is intended to be a manual pre-setting adjustment, the adjustment of one or both sleeves 11, 11′ could be effected automatically, for example by means of a pneumatic or oil-operated pressure device or electro-magnetically, in response to any operating parameter of the compressor or the engine of which it is a component. FIG. 5 illustrates a modification in which the screws 17 are replaced by one or more rams 25 connected to a piston 26 in a double-acting cylinder 27 to which operating fluid is applied or exhausted through pipes 28, 29 in response to the operating parameter of the compressor or cylinder. The sleeve 11 is guided for movement in directions parallel with the axis of rotation of the compressor rotor by a screw 30 engageable in a guide slot in the sleeve 11 extending parallel to the axis of rotation of the compressor rotor.

Figure 6:
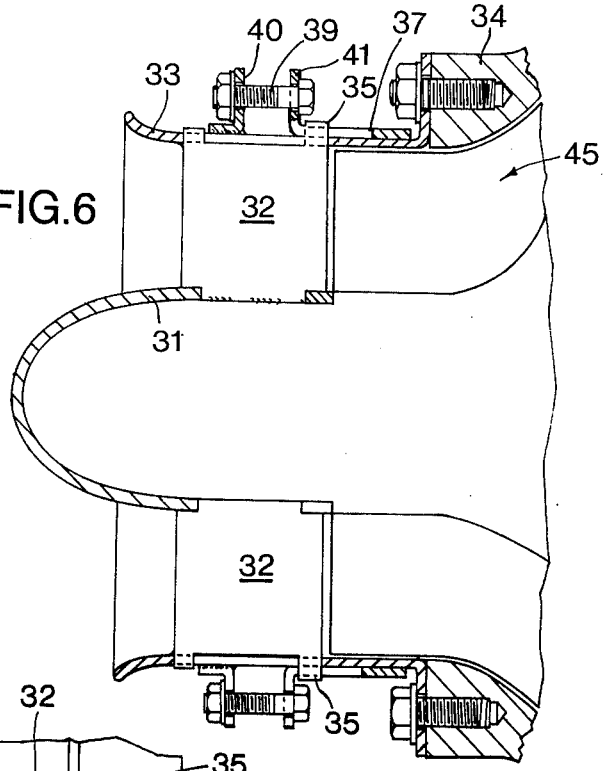
FIG. 6 is an axial sectional view through the second embodiment of inlet guide vane assembly.
Figure 7:
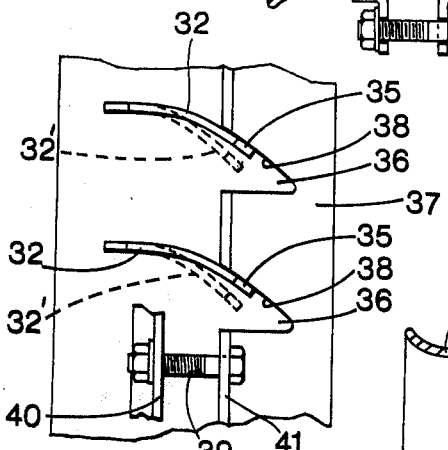
FIG. 7 is a development of an arcuate portion of a vane-deflecting member shown in FIG. 6 and also showing two circumferentially-adjacent vanes in transverse cross-section.

In the second embodiment shown in FIGS. 6 and 7, a hublike member 31 mounted co-axially with a centrifugal impeller 45 carries a plurality of radially-extending and circumferentially-spaced guide vanes 32 mounted at their outer ends in a stationary annular housing 33 mounted on the end of the compressor housing 34. The left-hand ends of the vane 32 are secured, for example by brazing to the members 31 and 33. The vanes 32 each carry a projecting lug 35 at their radially outer right-hand corner, each lug 35 being engageable in a notch 36 (see FIG. 27) in a sleeve 37 slidable axially along the outside of the annular member 33. The lug 35 engages and edge 38 of the corresponding notch 36 in the sleeve 37. As the sleeve 37 is moved axially from the position shown in FIGS. 6 and 7 to the left, the edge 38 will engage the lug 35 and deflect the vane 32 from the position shown in full lines to the position shown in broken lines at 32′ in FIG. 7 at the radially outer ends of the vanes. The radially inner ends of the vanes 32 remain in the position indicated in full lines at 32 in FIG. 7 as the vanes are secured, for example by brazing, to the member 31 along the axial length of each vane 32. Thus the vane 32 will be twisted as it changes from zero deflection at the radially-inner end to maximum deflection at the radially-outer end. The adjustment of the sleeve 37 is a pre-adjustment performed manually by means of several circumferentially-spaced screws 39 acting between a fixed bracket 40 mounted on the outer annular member 33 and a slidable bracket 41 carrying the sleeve 37.

Figure 2:
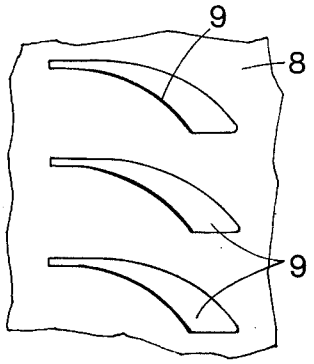
FIG. 2 is a development of a portion of a fixed sleeve shown in FIG. 1.
Figure 8:
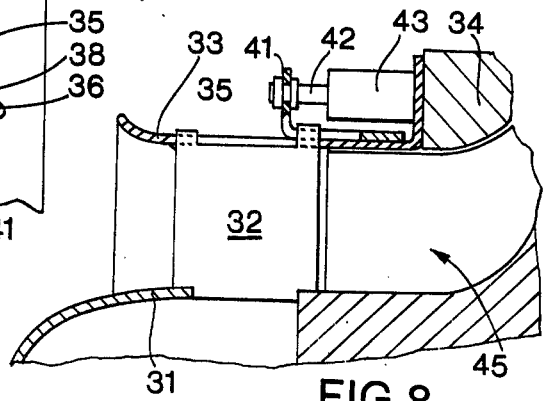
FIG. 8 is an axial sectional view similar to a portion of FIG. 6 but showing a modification including an actuator for moving an axially slidable sleeve also shown in FIGS. 6 and 7.

As for the embodiments shown in FIGS. 1 and 2, the adjustment of the sleeve 37 may alternatively be performed automatically in response to an operating parameter of the compressor or of the engine of which it is a component. FIG. 8 shows a modification in which instead of providing screws 39, the bracket 41 is attached to a ram 42 by an actuating cylinder 43 carried on the housing 34 and to which an actuating fluid signal is applied in response to the operating parameter.

The vanes 10 or 32 in either embodiment may be made of metal, plastics or other material which is sufficiently flexible to permit the described deflection of twisting.

What we claim as our invention and desire to secure by Letters Patent of the United States is:

1. A stator vane assembly for a gas turbine engine, the stator vane assembly comprising a pair of radially spaced co-axial annular walls mounted co-axially of a rotor of the engine, a plurality of circumferentially-spaced flexibile stator vanes extending in a generally radial direction between said annular walls, an axially movable annular vane-deflecting member having a plurality of circumferentially-spaced surfaces formed thereon, each said surface embracing a respective one of said vanes over at least a substantial part of a working surface of said vane in the widthwise direction thereof, said surfaces on said vane-deflecting member and hence said working surfaces of said vanes being curved in the widthwise directions of said vanes, and means to move said vane-deflecting member axially relatively to said vanes to embrace said working surface of each vane with a different part of a respective one of said surfaces of said vane-deflecting member to deflect said vanes in the widthwise directions thereof in the region of said vane-deflecting member.

2. A stator vane assembly as claimed in claim 1 including an axially fixed annular wall adjacent said vane-deflecting member, said axially fixed annular wall having a plurality of circumferentially-spaced apertures therein, each said vane extending through a respective one of said apertures in said axially fixed annular wall, each said vane being deflectable in the respective aperture between two limiting cross-sectional shapes determined by the shape of two respective boundary edges of said aperture, said annular vane-deflectable member being axially movable between two extreme positions in one of each vane engages one of said boundary edges and in the other of which each said vane engages the other of said boundary edges of the respective said apertures and said vane-deflecting member having a plurality of slots therein each bounded by a pair of said surfaces each embracing a working surface of the respective vane.

3. A stator vane assembly as claimed in claim 2 in which there is one said axially fixed annular wall adjacent each radial end of the vanes and a pair of said annular vane-deflecting members, one adjacent each said sleeve.

4. A stator vane assembly as claimed in claim 3 in which there are separate means to move each said annular vane-deflecting member, both said means being adjustable axially in unison.

5. A stator vane assembly as claimed in claim 3 in which there are separate means to move each said annular vane-deflecting member, each said means being adjustable axially individually of the other.

6. A stator vane assembly as claimed in claim 1 in which said annular vane-deflecting member has a plurality of circumferentially-spaced notches in an edge thereof adjacent the adjacent axial end edges of said vanes, each said notch being bounded in part by said surface embracing an adjacent edge portion of said working surface of the respective vane.

7. A stator vane assembly as claimed in claim 1 in which said means to move said vane-deflecting member axially is operable manually.

8. A stator vane assembly as claimed in claim 1 in which said means to move said vane-deflecting member axially is operable automatically in response to change in an operating parameter of the engine.

* * * * *

UNITED STATES PATENT OFFICE

CERTIFICATE OF CORRECTION

Patent No. 4,029,433 Dated June 14, 1977

Inventor(s) Robert Noel Penny et al.

It is certified that error appears in the above-identified patent and that said Letters Patent are hereby corrected as shown below:

Column 1, line 12, after "parameter" delete "of" and insert -- on --.

Column 4, line 16, after "FIG." delete "27" and insert -- 2 --.

Column 5, line 15, before "each" insert -- which --.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,029,433

DATED : June 14, 1977

INVENTOR(S) : Robert Noel Penny et al

It is certified that error appears in the above-identified patent and that said Letters Patent are hereby corrected as shown below:

Column 1, line 12, after "parameter" delete "of" and insert --on--.

Column 4, line 16, after "FIG.", delete "27" and insert --7--.

Column 5, line 15, before "each" insert --which--.

This Certificate supersedes Certificate of Correction issued October 18, 1977.

Signed and Sealed this

*Third* Day of *October 1978*

[SEAL]

*Attest:*

RUTH C. MASON
*Attesting Officer*

DONALD W. BANNER
*Commissioner of Patents and Trademarks*